US007137832B2

(12) United States Patent
Mongold et al.

(10) Patent No.: US 7,137,832 B2
(45) Date of Patent: Nov. 21, 2006

(54) ARRAY CONNECTOR HAVING IMPROVED ELECTRICAL CHARACTERISTICS AND INCREASED SIGNAL PINS WITH DECREASED GROUND PINS

(75) Inventors: John A. Mongold, Middletown, PA (US); Julian J. Ferry, Dillsburg, PA (US); Todd J. Kuvshinikov, Etters, PA (US)

(73) Assignee: Samtec Incorporated, New Albany, IN (US)

( * ) Notice: Subject to any disclaimer, the term of this patent is extended or adjusted under 35 U.S.C. 154(b) by 11 days.

(21) Appl. No.: 10/942,794

(22) Filed: Sep. 17, 2004

(65) Prior Publication Data

US 2005/0277315 A1 Dec. 15, 2005

Related U.S. Application Data

(63) Continuation-in-part of application No. 10/865,128, filed on Jun. 10, 2004.

(51) Int. Cl.
*H01R 11/20* (2006.01)

(52) U.S. Cl. ..... 439/108; 439/941

(58) Field of Classification Search ..... 439/79, 439/608, 108, 941
See application file for complete search history.

(56) References Cited

U.S. PATENT DOCUMENTS 4,157,612 A 6/1979 Rainal
5,779,502 A 7/1998 Daftari et al.
6,384,341 B1 5/2002 Rothermel et al.
6,461,202 B1 * 10/2002 Kline ..... 439/701
6,503,103 B1 * 1/2003 Cohen et al. ..... 439/608
6,506,076 B1 * 1/2003 Cohen et al. ..... 439/608
6,527,587 B1 * 3/2003 Ortega et al. ..... 439/608
6,551,140 B1 * 4/2003 Billman et al. ..... 439/608
6,554,647 B1 * 4/2003 Cohen et al. ..... 439/607
6,572,409 B1 * 6/2003 Nitta et al. ..... 439/608
6,602,095 B1 * 8/2003 Astbury et al. ..... 439/608
6,607,402 B1 * 8/2003 Cohen et al. ..... 439/608
6,609,933 B1 * 8/2003 Yamasaki ..... 439/608
6,652,318 B1 * 11/2003 Winings et al. ..... 439/608
6,659,808 B1 * 12/2003 Billman et al. ..... 439/680
6,692,272 B1 * 2/2004 Lemke et al. ..... 439/108
6,695,627 B1 * 2/2004 Ortega et al. ..... 439/78
6,705,903 B1 3/2004 Yu
6,743,057 B1 * 6/2004 Davis et al. ..... 439/701
6,808,420 B1 * 10/2004 Whiteman et al. ..... 439/608
6,814,590 B1 * 11/2004 Minich et al. ..... 439/79
6,814,619 B1 * 11/2004 Stokoe et al. ..... 439/608
6,843,686 B1 * 1/2005 Ohnishi et al. ..... 439/608

(Continued)

OTHER PUBLICATIONS

"Mezzanine High-Speed High-Density Connectors: Gig-Array™ and Meg-Array® Connectors," FCI USA, Inc., Feb. 2002, Nevada.

(Continued)

*Primary Examiner*—Ross Gushi
(74) *Attorney, Agent, or Firm*—Keating & Bennett, LLP

(57) ABSTRACT

An electrical connector includes a connector body, a plurality of rows and columns of conductive pins disposed along the length direction and the width direction of the connector body so as to form an array of signal pins located in a pin field, at least two rows of ground pins arranged along at least two sides of the pin field, with no ground pins being arranged in the pin field or between adjacent signal pins. The signal pins are arranged in a stretched pitch and/or staggered configuration to minimize cross-talk and maximize signal pin density and signal-to-ground ratio.

26 Claims, 12 Drawing Sheets

U.S. PATENT DOCUMENTS

| | | | | |
|---|---|---|---|---|
| 6,863,543 | B1 * | 3/2005 | Lang et al. | 439/75 |
| 6,869,292 | B1 * | 3/2005 | Johnescu et al. | 439/74 |
| 6,872,085 | B1 * | 3/2005 | Cohen et al. | 439/108 |
| 6,913,490 | B1 * | 7/2005 | Whiteman et al. | 439/608 |
| 6,918,776 | B1 * | 7/2005 | Spink, Jr. | 439/74 |
| 6,976,886 | B1 * | 12/2005 | Winings et al. | 439/701 |
| 6,981,883 | B1 * | 1/2006 | Raistrick et al. | 439/74 |
| 2002/0111068 | A1 * | 8/2002 | Cohen et al. | 439/608 |
| 2003/0027439 | A1 | 2/2003 | Johnescu et al. | |
| 2003/0143894 | A1 * | 7/2003 | Kline et al. | 439/608 |
| 2003/0171010 | A1 * | 9/2003 | Winings et al. | 439/55 |
| 2003/0186594 | A1 * | 10/2003 | Davis et al. | 439/701 |
| 2003/0220018 | A1 * | 11/2003 | Winings et al. | 439/608 |
| 2003/0220021 | A1 * | 11/2003 | Whiteman et al. | 439/608 |
| 2004/0097112 | A1 * | 5/2004 | Minich et al. | 439/101 |
| 2005/0020109 | A1 * | 1/2005 | Raistrick et al. | 439/108 |
| 2005/0148239 | A1 * | 7/2005 | Hull et al. | 439/608 |
| 2005/0164555 | A1 * | 7/2005 | Winings et al. | 439/608 |
| 2005/0170700 | A1 * | 8/2005 | Shuey et al. | 439/701 |
| 2005/0196987 | A1 * | 9/2005 | Shuey et al. | 439/108 |
| 2005/0287849 | A1 * | 12/2005 | Winings et al. | 439/108 |
| 2005/0287850 | A1 * | 12/2005 | Minich et al. | 439/108 |
| 2006/0019517 | A1 * | 1/2006 | Raistrick et al. | 439/108 |
| 2006/0019538 | A1 * | 1/2006 | Davis et al. | 439/608 |
| 2006/0063404 | A1 * | 3/2006 | Minich et al. | 439/79 |

OTHER PUBLICATIONS

"Gig-Array™ High Speed Mezzanine Connectors 15-35 mm Board to Board (revision 8)," FCI USA, Inc., Feb. 21, 2001, Nevada.

"Gig-Array® High Speed Mezzanine Connectors 15-35 mm Board to Board (revision C)," FCI USA, Inc., Mar. 24, 2004, Nevada.

"Gig-Array® High Speed Mezzanine Connectors 15-35 mm Board to Board (revision C)," FCI USA, Inc., Apr. 22, 2004, Nevada.

Kopec et al., "Gig-Array® Qualification Testing," FCI USA, Inc.-CDC Div, Oct. 13, 2002, pp. 1-21, Etters, PA.

U.S. Appl. No. 10/865,128, filed Jun. 10, 2004; "Array connector having improved electrical characteristics and increased signal pins with decreased ground pins."

Office Action dated Aug. 11, 2005; Issued in U.S. Appl. No. 10/865,128.

* cited by examiner

ARRAY CONNECTOR HAVING IMPROVED ELECTRICAL CHARACTERISTICS AND INCREASED SIGNAL PINS WITH DECREASED GROUND PINS

This application is a Continuation-in-Part of U.S. patent application Ser. No. 10/865,128, filed on Jun. 10, 2004, currently pending.

BACKGROUND OF THE INVENTION

1. Field of the Invention

The present invention relates to electrical connectors. More specifically, the present invention relates to array connectors, which can be a single-ended array connector or a differential pair array connector, which uses far fewer ground pins or blades and has a greater number of signal pins and achieves significantly improved electrical characteristics.

2. Description of the Related Art

It is known to provide an electrical connector, such as a board-to-board mezzanine connector, having a regular array of signal pins in a pin field. The signal pins must be surrounded by ground pins or ground blades or planes, which are provided both within the pin field and surrounding the pin field in order to prevent cross-talk between adjacent signal pins and to prevent EMI emissions from the pin field to the outside of the connector. For example, US 2003/0027439 A1, to Johnescu et al., teaches surrounding each of the signal pins with ground contacts or ground planes.

The use of so many pins as ground pins or the use of ground blades in between adjacent signal pins may increase the size of the connector, may decrease the number of signal pins that can be present in the connector, or both. If the size of the connector is reduced, then there is a corresponding reduction in the number of signal pins and signal to ground ratio.

These problems are especially difficult in a differential pair array connector where differential signals are passed through the connector.

In order to reduce crosstalk between adjacent differential signal pairs, typically a plurality of ground pins or ground planes are placed between the adjacent differential signal pairs. Although this arrangement results in better electrical performance, the overall signal pin density is decreased.

For example, as shown in FIG. 1, a connector includes a 7×7 array of pins 1 in a pin field. Each of the differential pairs 4 of signal pins 2 (indicated with crosshatching in FIG. 1) must be surrounded by ground pins 3 (indicated without crosshatching in FIG. 1) in order to provide proper shielding and prevent crosstalk between adjacent differential pairs 4. As a result, only six differential pairs 4 are possible in the 7×7 pin array of FIG. 1.

Typically, signal pins have a broader side and a narrower side, and when the broader sides of the signal pins of adjacent differential signal pairs are aligned with each other, much greater cross-talk occurs. In addition, the ground pins or ground blades must be arranged so as to surround the differential signal pairs to eliminate the disadvantageous broadside coupling between adjacent differential signal pairs. Thus, in such arrangements, ground pins or ground blades must be provided in between the adjacent differential signal pairs to attempt to minimize such disadvantageous broadside coupling.

As is clear from the above description, one of the unsolved problems of prior art array connectors is how to increase signal pin density without increasing the size of the connector or decreasing the quality of the electrical characteristics of the connector, and without complicating the arrangement of ground pins or ground blades.

Conventional array connector design dictates that the number of ground pins or ground blades cannot be minimized or eliminated without a concomitant increase in cross-talk and deterioration of electrical characteristics of the connector or PCB layout and/or routing. No suitable solution to this problem has been developed.

Another problem that occurs with such array connectors of the prior art is the use of so many ground pins requires a much more complex design and connection process for the PCB upon which the connector will be mounted and used. Because so many ground pins must be used in the pin field, a much greater number of PCB layers, traces, and vias must be used to properly route and connect the ground pins, which makes the PCB design and manufacturing process much more difficult, as well as, making the connection of the array connector to the PCB more difficult. Also, with the increased number of PCB layers, traces, and vias, there is much greater chance for having impedance mismatch problems, increased crosstalk, and greatly increased manufacturing complexity and overall design cost.

In addition, most array connectors have a unique signal arrangement and thus, require a unique ground arrangement. Thus, ground contacts and shields must be specially designed for each array connector, thereby requiring unique tooling and assembly equipment for each component of the connector. Also, the contact and terminal solder termination and retention features are non-uniform and different for each connector. This greatly increases the complexity and cost of manufacturing such connectors and related PCBs. That is, a standard pin arrangement and construction of an array connector cannot be adapted to various unique array connector designs.

SUMMARY OF THE INVENTION

In order to overcome the unsolved problems of the prior art described above, preferred embodiments of the present invention provide an electrical connector having the same or reduced size, and which includes a much higher number of signal pins and a much lower number of ground pins or ground blades, while greatly improving the electrical characteristics thereof, such as improved electrical characteristics, greatly reduced cross-talk, increased bandwidth, improved impedance matching, improved PCB routability, improved PCB routing electrical characteristics, greatly reduced PCB routing cross-talk, increased PCB routing bandwidth, improved PCB routing impedance matching, easier PCB design and manufacturing, and greatly reduced EMI emissions from the connector.

According to a preferred embodiment of the present invention, an electrical connector includes a connector body, a plurality of pins arranged in the connector body to define a pin field, the plurality of pins including a plurality of signal pins and a plurality of ground pins, wherein the ground pins are arranged only at a periphery of the pin field.

It is preferred that the signal pins and ground pins have the same configuration (e.g., size, shape, material composition, etc.). However, it is possible to make the signal pins and ground pins to have different configurations, as desired.

In a further preferred embodiment of the present invention, an electrical connector includes a connector body, and a plurality of rows of signal pin pairs disposed along a first direction of the connector body, each of the signal pin pairs including first and second signal pins aligned in a second direction of the connector body, wherein adjacent rows of the signal pin pairs are staggered in the first direction of the connector body such that any of the signal pin pairs of one row do not align in the second direction with any of the signal pin pairs of an adjacent row of signal pin pairs.

In another preferred embodiment of the present invention, an electrical connector includes a connector body, a plurality of pins arranged in the connector body to define a pin field having rows and columns of pins, the plurality of pins including a plurality of signal pins and a plurality of ground pins, wherein a distance between adjacent pins in the direction of the rows is different from a distance between adjacent pins in a direction of the columns.

In the preferred embodiments described above, the periphery of the pin field includes four sides and the ground pins are preferably located along two of the four sides of the periphery of the pin field. Also, the signal pins are preferably arranged in rows in between at least two outer rows of ground pins.

It should be noted however, the present invention is not limited to the ground pins being disposed along two of the four sides of the periphery of the pin field. The ground pins could be omitted from the periphery of the pin field, or could be located along one, two, three or four sides of the periphery of the pin field, as desired. If the ground pins are omitted from the periphery of the pin field, some of the signal pins in the pin field are preferably connected to function as ground pins.

It is also preferred that the signal pins are arranged in differential pairs and that the connector is either a differential pair array connector or a single ended array connector.

Each of the signal pins preferably has a broader side and a narrower side, the broader sides of the signal pins of each of the differential pairs being aligned with each other, and the narrower sides of the signal pins of different adjacent differential pairs being aligned with each other.

The pins are preferably arranged in rows and columns of the pin field, and a first group of signal pins which are adjacent to each other in the column direction are spaced from each other by a distance that is approximately equal to a length of a broader side of one of the signal pins in each of the rows, and a second group of signal pins which are adjacent to each other in the column direction are spaced from each other by a distance that is approximately equal to one half of a length of a broader side of one of the signal pins in each of the rows.

It is also preferred that the signal pins which are adjacent to each other in the row direction are spaced from each other by a distance that is approximately equal to a length of a broader side of one of the signal pins.

In other preferred embodiments, within the pin field, differential pairs of signal pins are provided and arranged in columns and rows of the pin field. It is preferred that the differential pairs in each of the rows is spaced from a different adjacent differential pair in the same row by a distance that is approximately equal to a length of a broader side of one of the signal pins of the differential pairs. It is also preferred that the two signal pins in each of the differential pairs are spaced from each other by a distance that is approximately equal to one half of a length of a broader side of one of the signal pins of the differential pairs.

Furthermore, it is preferred that the differential pairs are arranged in a stretched pattern along the direction of the rows of the pin field such that for each row of differential pairs, a distance between signal pins along the row direction is not equal to a distance between signal pins along the column direction.

As a result of the arrangements described above, it is preferred that the differential pairs are arranged in a zig-zag pattern along the direction of the columns of the pin field.

The connector body preferably includes a plurality of cores which are arranged in a staggered and/or staggered pattern to produce the zig-zag arrangement of pins described above. The connector body is preferably made of plastic and the ground shield is plated on certain surfaces of the plastic of the connector body.

In another preferred embodiment, a ground shield extends along the perimeter of the connector body and is preferably connected to at least one of the plurality of pins.

The connector body preferably includes at least one standoff for maintaining a minimum distance between the connector body and a circuit board upon which the connector is mounted.

It should be noted that the above-described unique arrangement and construction of the pins of a connector can be applied to a differential pair array connector, a single ended array connector and any other type of connector.

Furthermore, other preferred embodiments are possible in which the unique arrangement and construction of the pins of a connector as described above are applied to one region of a pin field and the arrangement and construction of the pins of another region of the same pin field are conventionally configured (e.g., arranged in an open pin field arrangement).

Also, another preferred embodiment is possible whereby the unique arrangement and construction of the pins of a connector have a first unique arrangement and construction of the pins in a first region of the pin field for differential pair signals and a second unique arrangement and construction of the pins in a second region of the pin field for single ended signals.

In another preferred embodiment of the present invention, a method of manufacturing a connector having the structural arrangement and features described with respect to the other preferred embodiments of the present invention is provided.

Other features, elements, characteristics, and advantages of the present invention will become more apparent from the following detailed description of preferred embodiments of the present invention with reference to the attached drawings.

DETAILED DESCRIPTION OF PREFERRED EMBODIMENTS

FIGS. 2, 3, 4, and 5 show an electrical connector 100 according to a preferred embodiment of the present invention. The electrical connector 100 includes a connector body 110 having a plurality of rows of pins 101.

It should be noted that the preferred embodiment shown in FIGS. 2–5 is preferably a differential pair array connector, but other connectors such as a single ended array connector or other types of connectors are possible with the present invention.

Figure 2:
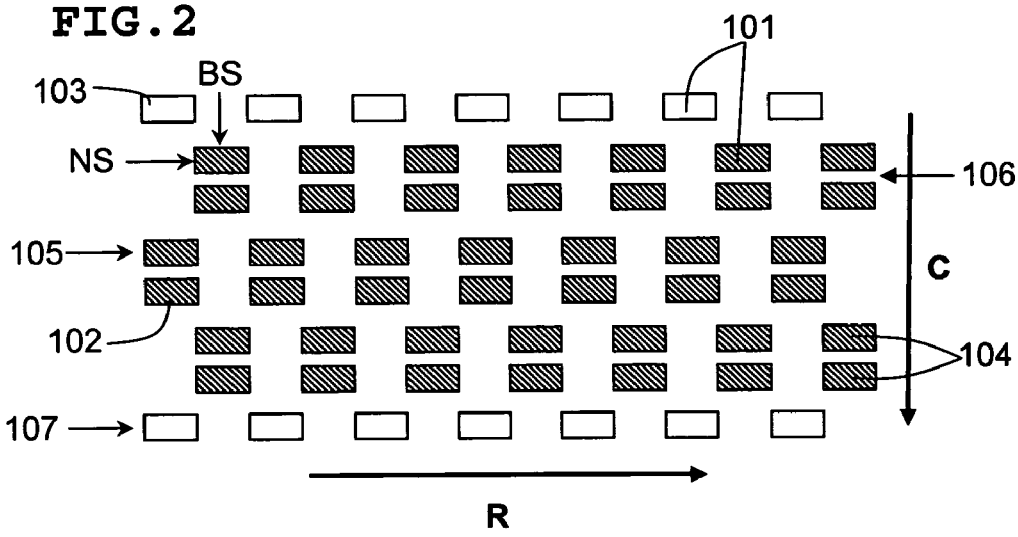
FIG. 2 is a schematic view of a pin field of an array connector according to a preferred embodiment of the present invention.

As seen in FIG. 2, an electrical connector 100 includes a plurality of the pins 101, which include signal pins 102 and ground pins 103, described in more detail below.

With respect to the physical aspects and structure of the signal pins 102 and ground pins 103, it is preferred that the signal pins 102 and ground pins 103 have the same configuration (e.g., size, shape, material composition, etc.). However, it is possible to make the signal pins 102 and ground pins 103 to have different configurations.

Figure 1:
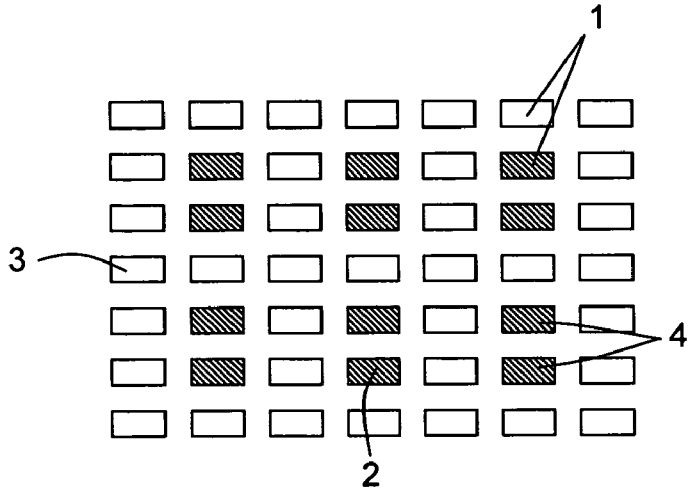
FIG.1 PRIOR ART
FIG. 1 is a schematic view of a pin field of a conventional array connector.

As is readily understood from FIG. 2, the various pins 101 have a staggered and stretched arrangement throughout the array of pins 101 due to varying distances between the pins, as compared with the uniformly spaced arrangement of the pins 2 and 3 in Prior Art FIG. 1. That is, as seen in FIG. 1, the distance between each of the pins 1 is the same and uniform for each pin 1, including signal pins 2 and ground pins 3. In contrast, as seen in FIG. 2, the distance between various pins 101 is different and non-uniform so as to produce the staggered and stretched arrangement shown in FIG. 2. The reasons for and advantages achieved by the staggered and stretched arrangement of the preferred embodiment shown in FIG. 2 will be described in more detail below.

According to another unique feature of the present preferred embodiment, ground pins 103 (indicated without crosshatching as in FIG. 1) are preferably provided only on the outer perimeter of the pin field, in this case, only on the top and bottom row of pins 101 shown in FIG. 2. The remaining pins in the pin field are all signal pins 102 (indicated with crosshatching as in FIG. 1) which are preferably arranged to define differential pairs 104 (although a single ended array connector is possible in the present invention as will be described). Thus, the ground pins 103 are preferably not provided in between adjacent signal pins 102 within the pin field.

Although FIG. 2 shows ground pins 103 on the top and bottom rows of the pin field, it should be noted that ground pins 103 can be provided on one or more peripheral sides of the pin field, such as on the top side only, on the bottom side only, or on the top and bottom sides, etc. Alternatively or in addition, additional ground pins 103 could be provided along the left and right sides of the pin field.

As can be seen in FIG. 2, the pin field includes a plurality of pins arranged in rows and columns. The row direction or direction in which each row extends is indicated by arrow R, and the column direction or direction in which each column extends is indicated by arrow C.

The staggered and stretched arrangement of the pins 101 is achieved by stretching the pitch of the pins 101 in the row direction R of the pin field and in the column direction of the pin field, and staggering the arrangement of the signal pins that define differential signal pairs 104 to produce a zig-zag arrangement of differential signal pairs 104 seen in FIG. 2, as compared to the uniformly-spaced, non-staggered arrangement of the pins 1 in FIG. 1.

In preferred embodiments of the present invention, the stretched pitch is achieved by setting the pitch P or distance between signal pins 102 which are adjacent to each other in the row direction R to be approximately equal to a length of the broadside BS of a signal pin, for example. This stretched pitch is also preferably the same for ground pins 103 which are adjacent to each other in the row direction R. The spacing or distance between signal pins 102 which are adjacent to each other in the row direction R, and the spacing or distance between ground pins 103 which are adjacent to each other in the row direction R, do not have to be approximately equal to the length of the broadside BS of a signal pin 102, and can be modified as desired as long as the effects and advantages of the present invention are achieved, as will be described below.

In addition, the stretched pitch is also preferably achieved by setting the pitch or distance between signal pins 102 which are adjacent to each other in the column direction C and provided in the same differential pair 104 to one half of the pitch P or distance between signal pins 102 which are adjacent to each other in the column direction C and are in separate differential pairs 104. In other words, the pitch between the two signal pins in each differential signal pair is preferably approximately equal to one half of the distance or pitch between adjacent rows of differential signal pairs.

It is also preferred that the pitch or distance between signal pins 102 which are adjacent to each other in the column direction C and provided in the same differential pair 104, is set to one half of the pitch or distance between a ground pin 103 and a signal pin 102 which are adjacent to each other in the column direction.

Also, it is preferred that the pitch or distance between signal pins 102 which are adjacent to each other in the column direction C and are in separate differential pairs 104, and the pitch or distance between a ground pin 103 and a signal pin 102 which are adjacent to each other in the column direction, be substantially equal to the pitch between signal pins 102 which are adjacent to each other in the row direction, and the pitch between ground pins 103 which are adjacent to each other in the row direction.

Thus, to summarize the stretched and staggered arrangement of FIG. 2:

Distance between row-direction-adjacent ground pins 103=P;

Distance between row-direction-adjacent signal pins 102=P;

Distance between column-direction-adjacent signal pins 102 in the same differential pair=0.5 P;

Distance between column-direction-adjacent signal pins 102 in two different column-direction-adjacent differential pairs=P;

Distance between a ground pin 103 and a column-direction-adjacent signal pin 102=P; wherein P is preferably approximately equal to a length of a broadside BS of the signal pin 102.

The staggered arrangement of the rows 106 of differential pairs 104 is preferably arranged such that none of the differential pairs 104 in one row of differential pairs align in the column direction with any of the differential pairs 104 of a column-direction-adjacent row of differential pairs 104.

Similarly, it is preferred that the ground pins 103 are arranged such that none of the ground pins 103 align in the column direction with any of the differential pairs 104 of a column-direction-adjacent row of differential pairs 104.

However, the present invention is not limited to the arrangement described in the preceding paragraph. It is possible for the ground pins 103 to be aligned in the column direction with the differential signal pairs 104. The effects and advantages of the present invention will still be achieved in such a configuration as long as the unique staggering and stretching of the differential pairs 104 is utilized. Such an arrangement will result in less ground pins being used in the pin field and much better electrical performance as described above.

Furthermore, it is also possible to arrange the ground pins 103 along only one peripheral side of the pin field, or along three or four peripheral sides of the pin field, or to omit the ground pins from the periphery of the pin field altogether. If the ground pins are omitted from the periphery of the pin field, some of the differential pair pins in the pin field are preferably used as ground pins, as seen in FIG. 15.

Figure 15:
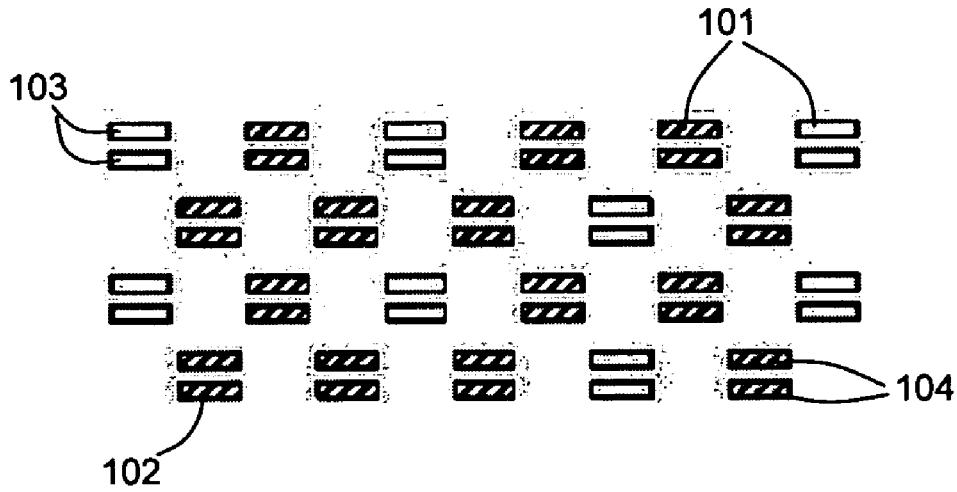
FIG. 15 is a schematic view of a pin field of an array connector according to an additional preferred embodiment of the present invention.

FIG. 15 shows a connector having a pin field that includes pins 101 arranged in a manner similar to that of FIG. 2, except that the ground pins 103 on the two peripheral sides (top and bottom) of the pin field included in FIG. 2 are omitted in the connector shown in FIG. 15, and ground pins 103 are provided at various locations within the pin field. The ground pins 103 in the pin field of the connector of FIG. 15 are provided by connecting selected ones of the pins 101 to ground to constitute ground pin pairs 103 in the pin field. Because of the unique staggering and stretching of the pins in the pin field as shown in FIG. 15, far fewer ground pins 103 are needed and the density of signal pins 102 within the pin field can be increased. In addition, the connector shown in FIG. 15 achieves the advantages and results described with reference to FIG. 2.

The spacing and distances described above with respect to FIG. 2 can be modified as desired as long as the effects and advantages of the present invention are achieved, as will be described below.

It should be noted that the preferred embodiment of FIGS. 2–5 shows a staggered and stretched arrangement achieved by the expanded and non-uniform spacing between the various pins 101 in both the row direction R and the column direction C. In other preferred embodiments, it is possible to use the expanded and non-uniform spacing only between signal pins 102 which are adjacent to each other in the row direction and ground pins 103 which are adjacent to each other in the row direction, or to use the expanded and non-uniform spacing between signal pins 102 which are adjacent to each other in the column direction. However, it is most preferred if the expanded and non-uniform spacing and distances are used in combination to achieve the staggered and stretched arrangement shown in FIG. 2.

According to yet another unique feature of various preferred embodiments of the present invention, the signal pins 102 are arranged in a unique way such that advantageous broadside coupling between adjacent signal pins 102 in the same differential pair 104 is maximized and disadvantageous broadside coupling between adjacent signal pins 102 not belonging to the same differential pair 104 is minimized. As described above, most pins 101 used in a connector have a broader side BS and a narrower side NS. With differential pairs 104, it is best to have as much coupling as possible between the two signal pins of the same differential signal pair. Accordingly, broadside coupling between the signal pins 102 of the same differential pair 104 is maximized by the arrangement of FIG. 2 because the broader side BS of each signal pin 102 is aligned with the broader side BS of its corresponding signal pin 102 for each differential pair 104, which maximizes the advantageous broadside coupling between signal pins 102 of the same differential pair 104.

As described above with respect to conventional array connectors, adjacent differential pairs 4 experience cross-talk because, as in the configuration shown in FIG. 1, the broader sides of the signal pins 2 of different adjacent differential signal pairs 4 are aligned with each other. In contrast, as seen in FIG. 2, the narrower side NS of each signal pin 102 is closest to the narrower side NS of the adjacent signal pins 102 in the same row 105 of signal pins. Also, the broader side BS of each signal pin 102 is spaced away from the broader side BS of each of the adjacent signal pins 102. Thus, the disadvantageous broadside coupling between different adjacent differential pairs 104 is minimized.

The staggered and stretched arrangement produced by the non-uniform pitches of the signal pins 102 and ground pins 103 of the configuration shown in FIG. 2 greatly reduces cross-talk because of the increased distance provided between adjacent differential pairs 104, and because of the maximized advantageous broadside coupling between signal pins 102 of the same differential pair 104 and minimized disadvantageous broadside coupling between different adjacent differential pairs 104. Because the pitch between signal pins 102 is stretched and staggered as shown in FIG. 2, there is a much greater distance between different adjacent differential pairs 104, which also greatly reduces crosstalk.

The greatly reduced crosstalk achieved by the staggered and stretched arrangement of signal pins and the maximized advantageous broadside coupling in the preferred embodiment of FIG. 2 eliminates the need for putting ground pins in the pin field. Thus, unlike the construction of FIG. 1, it is not necessary to put ground pins 103 in between signal pins 102 in the pin field in the present invention. As a result, the ground pins 103 are preferably located only at the periphery of the electrical connector 100 as seen in FIG. 2. The ground pins 103 can be located at one, two or more peripheral sides of the electrical connector 100, as desired.

The ground pins 103, arranged as shown in FIG. 2, greatly reduce electromagnetic interference emissions from the pin field and the connector to outside thereof because the ground pins 103 are located along the perimeter of connector body 110. Further, because the ground pins 103 are preferably provided only on the outer periphery of the pin field, a much smaller number of ground pins is necessary and a much greater number of signal pins can be provided in the pin field. Thus, signal pin density is greatly increased and ground pin density is greatly decreased while being able to provide greatly improved electrical characteristics such as less cross-talk, improved impedance matching, lower EMI transmission, and increased electrical coupling between signal pins of each differential pair.

In addition, because the number of ground pins being used is greatly reduced, a much less complicated circuit board with far fewer layers, traces and vias can be used with the electrical connector 100, as described below. Thus, the design, manufacturing and assembly of the connector shown in FIG. 2 is much easier and far more cost-effective than the prior art connectors, while providing better performance and electrical characteristics as compared with conventional connectors.

Also, no increase in size of the connector is required, despite the use of the staggered and stretched arrangement shown in FIG. 2. It is also possible to actually reduce the size of the connector despite the use of many more signal pins 102. This is because of the elimination of so many ground pins 103 in the pin field and because the air gap between the adjacent signal pins 102 in the pin field requires much less area than the area required for putting ground pins 103 between adjacent signal pins 102. Thus, when comparing a conventional connector and a connector according to preferred embodiments of the present invention that have the same size, the connector according to preferred embodiments of the present invention has a much greater number of signal pins and much smaller number of ground pins in the same area.

Figure 3:
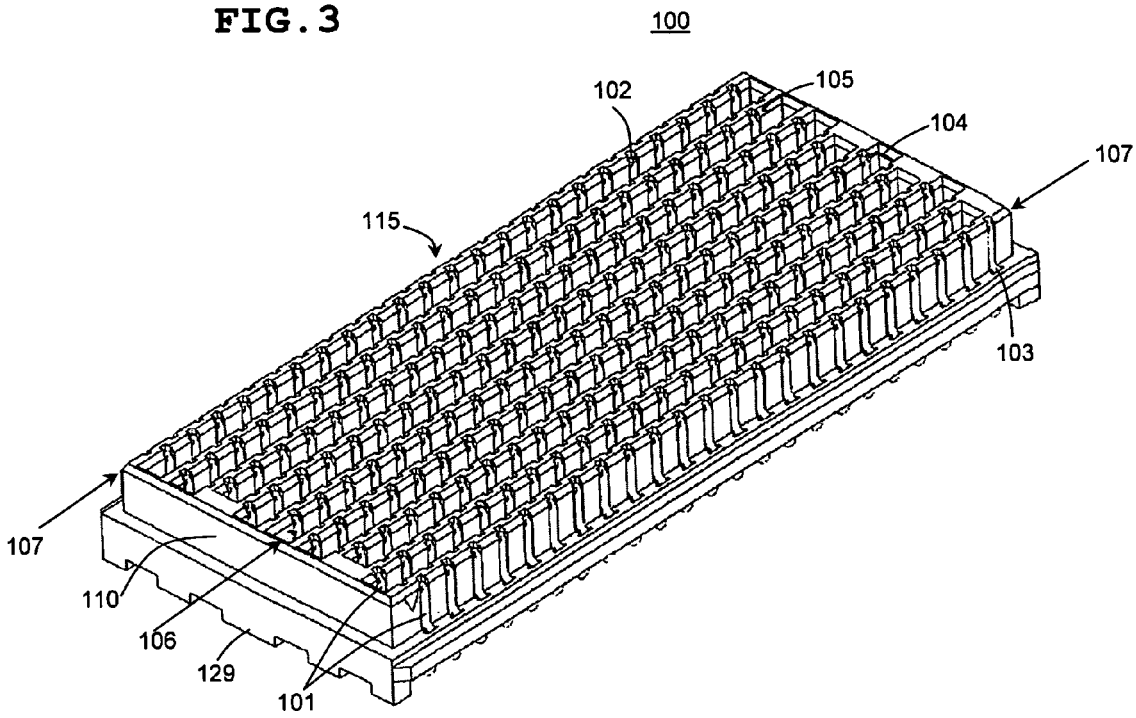
FIG. 3 is a top isometric view of a connector according to a preferred embodiment of the present invention.

FIG. 3 illustrates an actual example of the electrical connector 100 described and shown schematically in FIG. 2. In the electrical connector 100 shown in FIG. 3, preferably the pins 101 of the two outermost rows 107 of pins are ground pins 103. The inner rows 105 of signal pins 102 are grouped into rows 106 of differential pairs 104. Each of the differential pairs 104 include opposed signal pins 102 that are arranged to be advantageously broadside coupled, i.e., the signal pins 102 are arranged such that the broader sides BS of the signal pins 102 in each differential pair 104 are aligned with each other. In each row 106 of differential pairs 104, adjacent signal pins 102 of different adjacent differential pairs 104 are edge-coupled through the narrower sides NS of the signal pins 102 so as to minimize crosstalk between different adjacent differential pairs 104.

The rows 106 of differential pairs 104 are preferably staggered arranged as described above with respect to FIG. 2 such that each of the differential pairs 104 of one row of differential pairs does not align in the width direction of the connector body 110 with any of the differential pairs 104 of adjacent rows of differential pairs. This produces the zig-zag pattern of differential pairs 104 seen in FIG. 2.

The opposing signal pins 102 of each differential pair 104 are preferably staggered by approximately one half pitch in the column direction C, where the pitch is preferably approximately equal to the thickness of the signal pins 102. Differential pairs 104 in the same row 106 of differential pairs preferably have a staggered pitch such that adjacent signal pins 102 are separated by approximately the length of the broader side BS of one of the signal pins 102.

With this arrangement, the advantageous coupling between the signal pins 102 of each differential pairs 104 is maximized and the disadvantageous coupling between signal pins 102 not in the same differential pairs 104 is minimized. Because the coupling between signal pins 102 not in the same differential pairs 104 is minimized, crosstalk among the signal pins 102 not in the same differential pairs 104 is greatly reduced.

Figure 4:
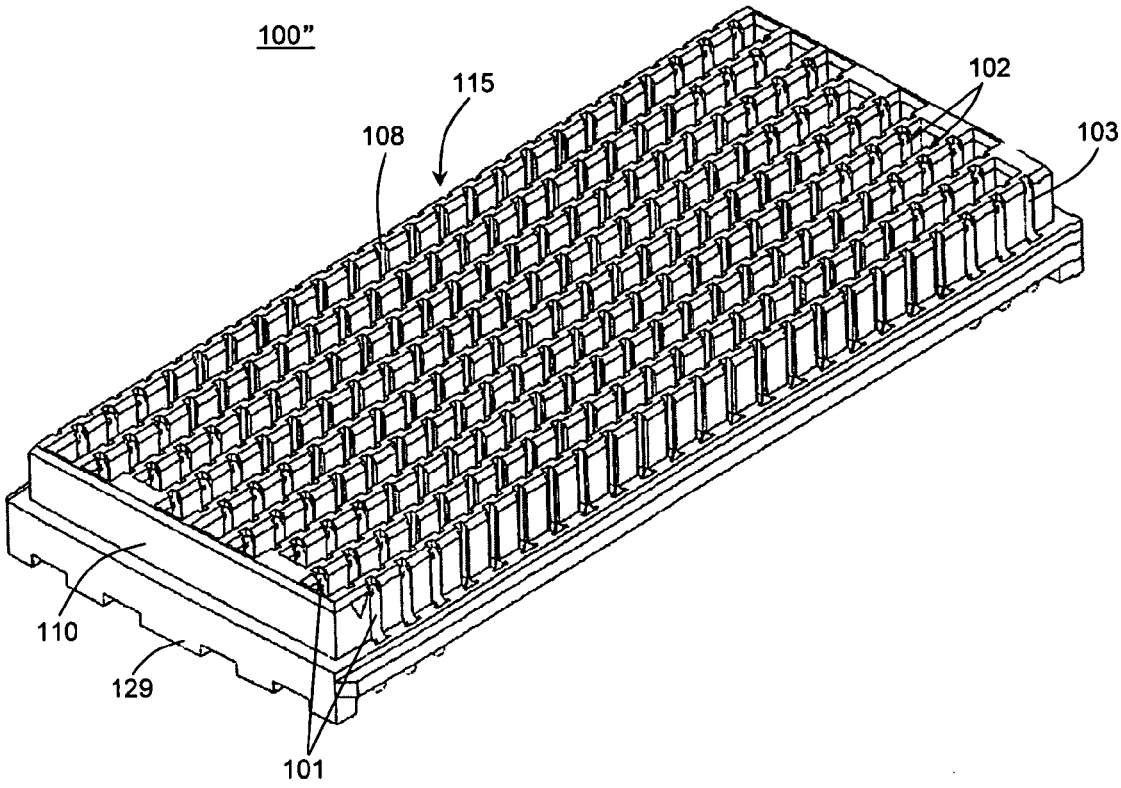
FIG. 4 is a top isometric view of a partially assembled connector according to a preferred embodiment of the present invention.

FIG. 4 shows a partially manufactured connector 100" according to a preferred embodiment of the present invention that only has some of pins 101 inserted into cores 108 formed in the connector body 110. Each of the pins 101 is preferably inserted from the bottom side of the connector body 110 into each of the cores 108.

It should be noted that in the connectors of FIGS. 3 and 4, the cores 108 of the connector body 110 are preferably arranged to have the staggered and stretched arrangement shown in FIG. 2. It is also possible to achieve the staggered and stretched pin arrangement shown in FIG. 2 by selectively inserting and not inserting pins 101 into the various cores 108 which are arranged in a uniform manner in a connector body 110.

Figure 11:
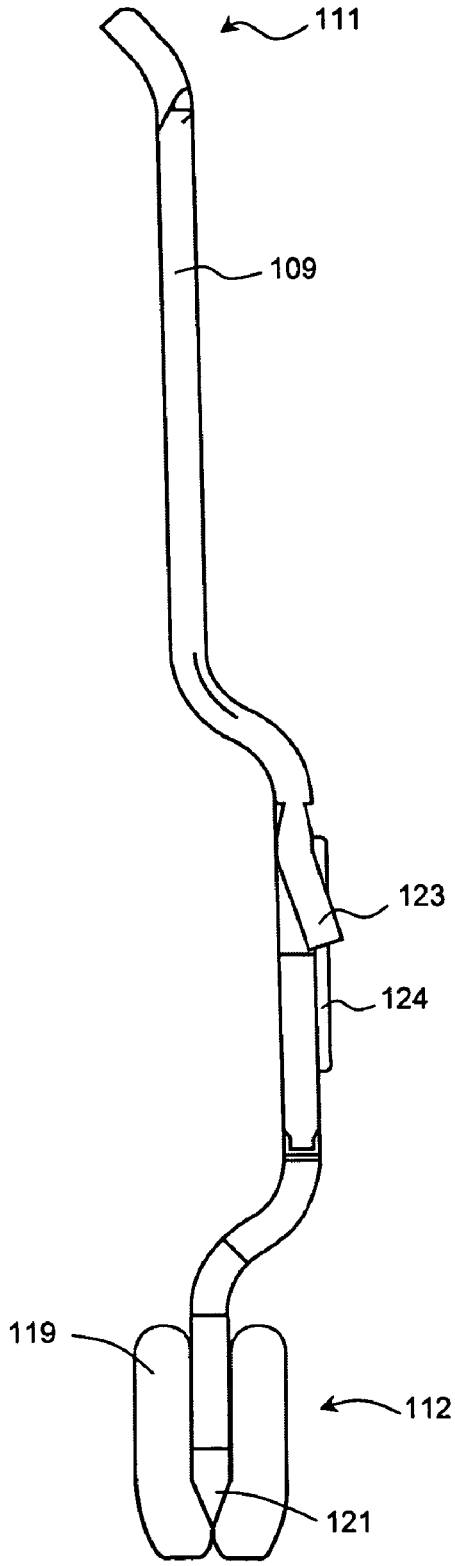
FIG. 11 is a front plan view of the pin according to a preferred embodiment of the present invention.
Figure 12:
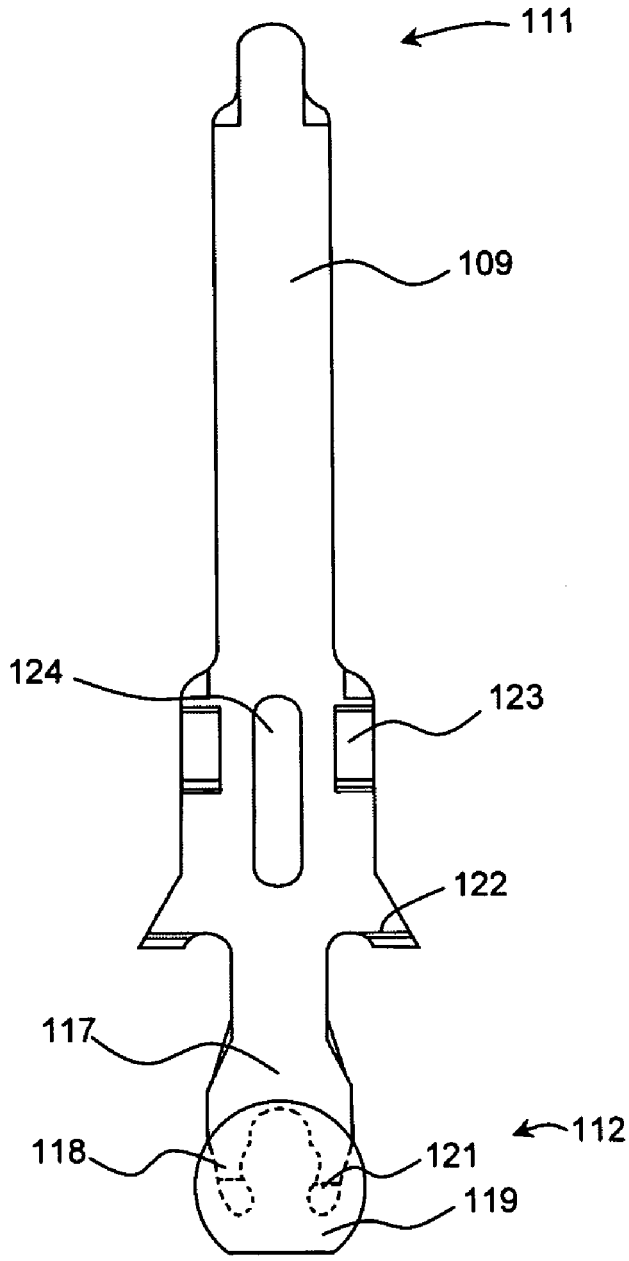
FIG. 12 is a side plan view of the pin according to a preferred embodiment of the present invention.

FIGS. 11 and 12 show the pin 101 that is preferably used in the electrical connector 100 according to a preferred embodiment of the present invention. The pin 101 includes a top 111 and a bottom 112.

The top 111 of the pin 101 is a mating contact portion. The shape of the top 111 of the pin 101 is determined by whether the connector is used as a header connector 115 as shown in FIG. 5 or used as a socket connector 120 as shown in FIG. 6.

Figure 5:
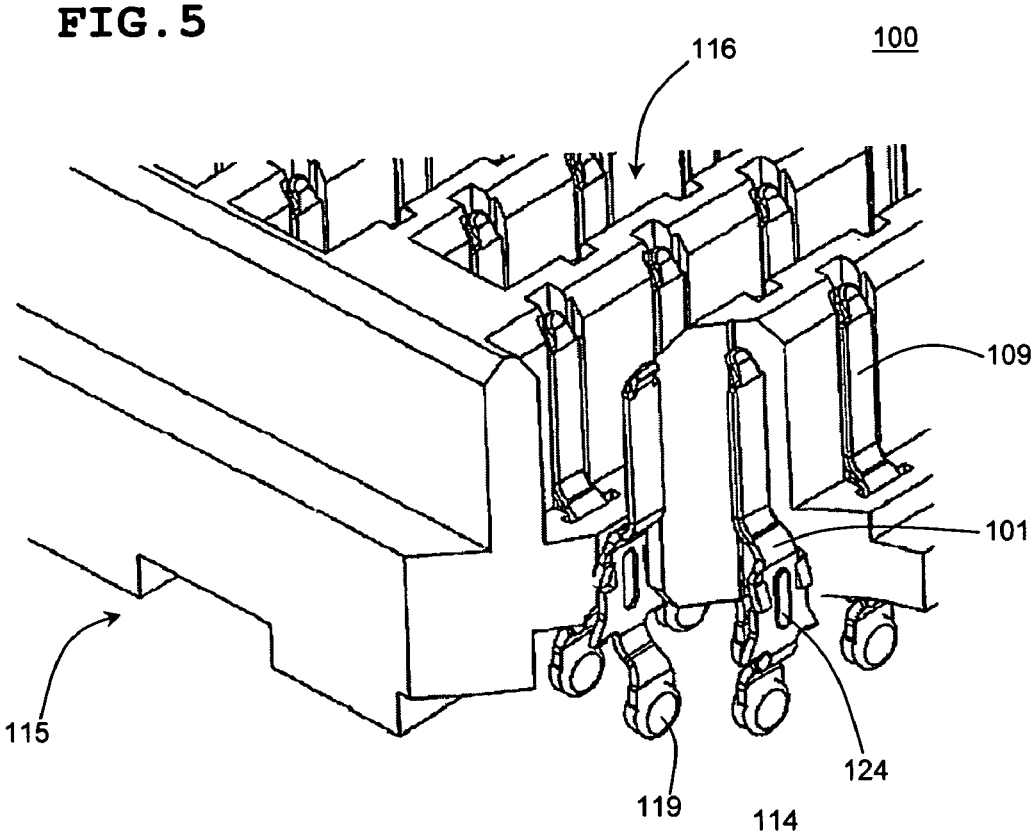
FIG. 5 is a close-up sectional view of a connector used as a header according to a preferred embodiment of the present invention.
Figure 6:
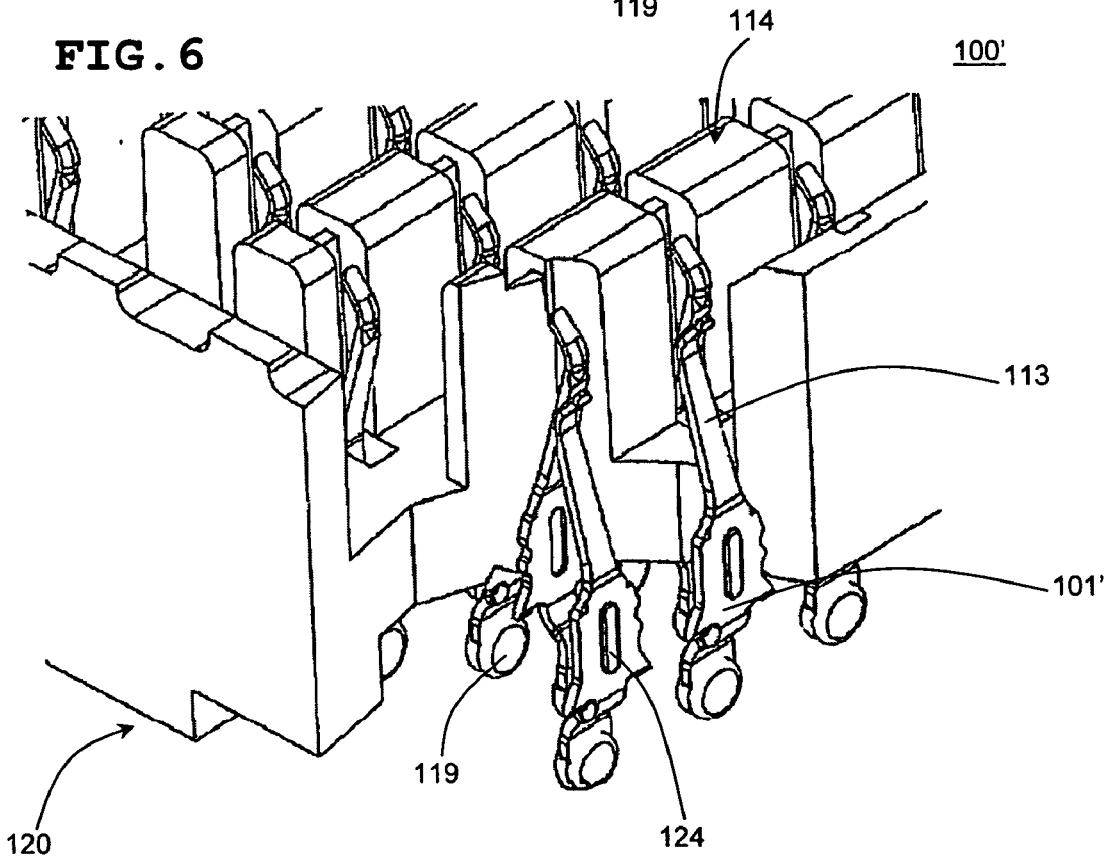
FIG. 6 is a close-up sectional view of a connector used as a socket according to a preferred embodiment of the present invention.
Figure 7:
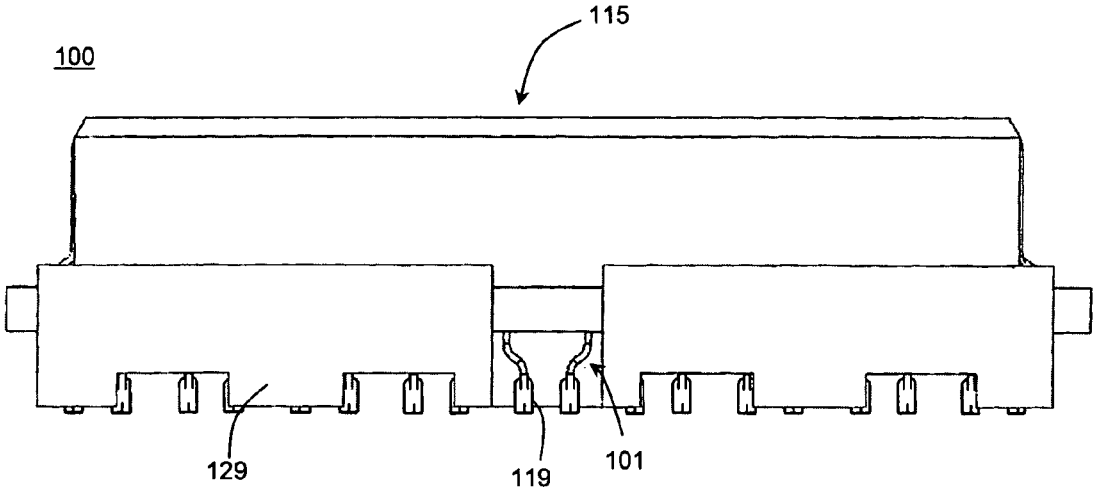
FIG. 7 is a side view of a connector according to a preferred embodiment of the present invention.

FIG. 5 shows an electrical connector 100 that is used as a header connector 115 with a plurality of signal pins 101, where the top 111 of each of the signal pins includes a contact portion 109 that is supported by the header connector body 110. FIG. 6 shows an electrical connector 100' that is used as a socket connector 120 with a plurality of signal pins 101', where the top 111' of each of the signal pin 101' includes a cantilevered portion 113.

When a header connector 115 and a socket connector 120 are mated, the socket wall 114 is inserted into the header groove 116, which separates the two rows of signal pins 101 that belong to the same row of differential pairs 106, such that the cantilever portion 113 of each of the signal pins 101' of the socket connector 120 mates with the contact portion 109 of a corresponding signal pin 101 of the header connector 115.

The bottom 112 of the pin 101 includes a tail portion 117 having arms 118. The arms 118 of the tail portion 117 are crimped so as to hold a solder member 119. The arms 118 of each of the tail portions 117 also preferably include a bevel 121. The bevel 121 of each of the tail portions 117 eliminates solder debris during the manufacture of the pin 101.

Instead of using a crimped solder termination as shown in FIGS. 5 and 6, solder balls, gull wing tails, or any other type of circuit board termination could be used.

Each of the pins 101 preferably includes wings 122 for engaging the bottom of the core 108 in order to maintain a consistent distance between the bottom 112 of the pin 101 and the connector body 110. Each of the pins 101 also preferably includes a pair of wedges 123 for engaging a side wall of a core 108 in order to fix the position of the pin 101 in the core 108. Each of the pins 101 further preferably includes a bump 124 for positioning the pin 101 in the core 108. Instead of being press fit in the housing 110 as described above, the pins can also be insert-molded.

Figure 8:
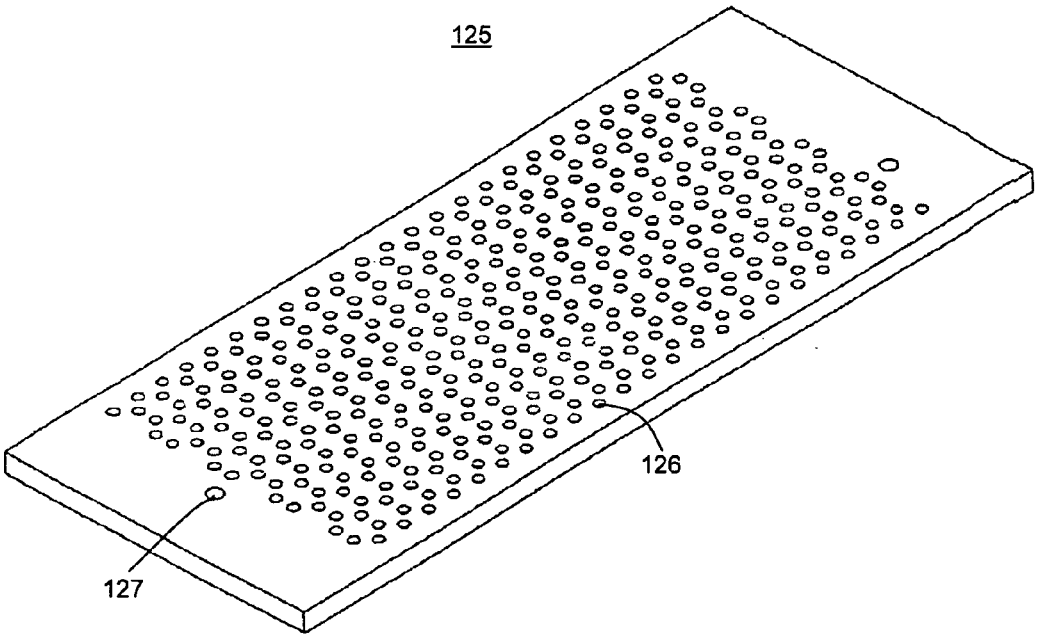
FIG. 8 is a top isometric view of circuit board according to a preferred embodiment of the present invention.

FIG. 8 shows a circuit board 125 that can be used with the electrical connector 100 or 100' according to preferred embodiments of the present invention. The circuit board 125 is preferably a printed circuit board. The circuit board 125 includes a plurality of pads 126 for connecting to corresponding pins 101 or 101' of the electrical connector 100 or 100'. The circuit board 125 also includes alignment holes 127 for engaging the alignment pins 128 of the electrical connector 100 or 100'.

The plurality of pads 126 are arranged in a similar pattern as the plurality of pins 101 or 101' of the electrical connector 100 or 100'. Each row of pads preferably has approximately the same stretched, non-uniform pitch as the signal pins described above. Further, the rows of pads also preferably have approximately the same staggered arrangement as the rows of differentially paired signal pins. Because the plurality of pads 126 are arranged in a similar pattern as the plurality of pins 101 or 101' of the electrical connector 100 or 100', crosstalk between the plurality of pads 126 not connected to the same differential pair is minimized.

Figure 9:
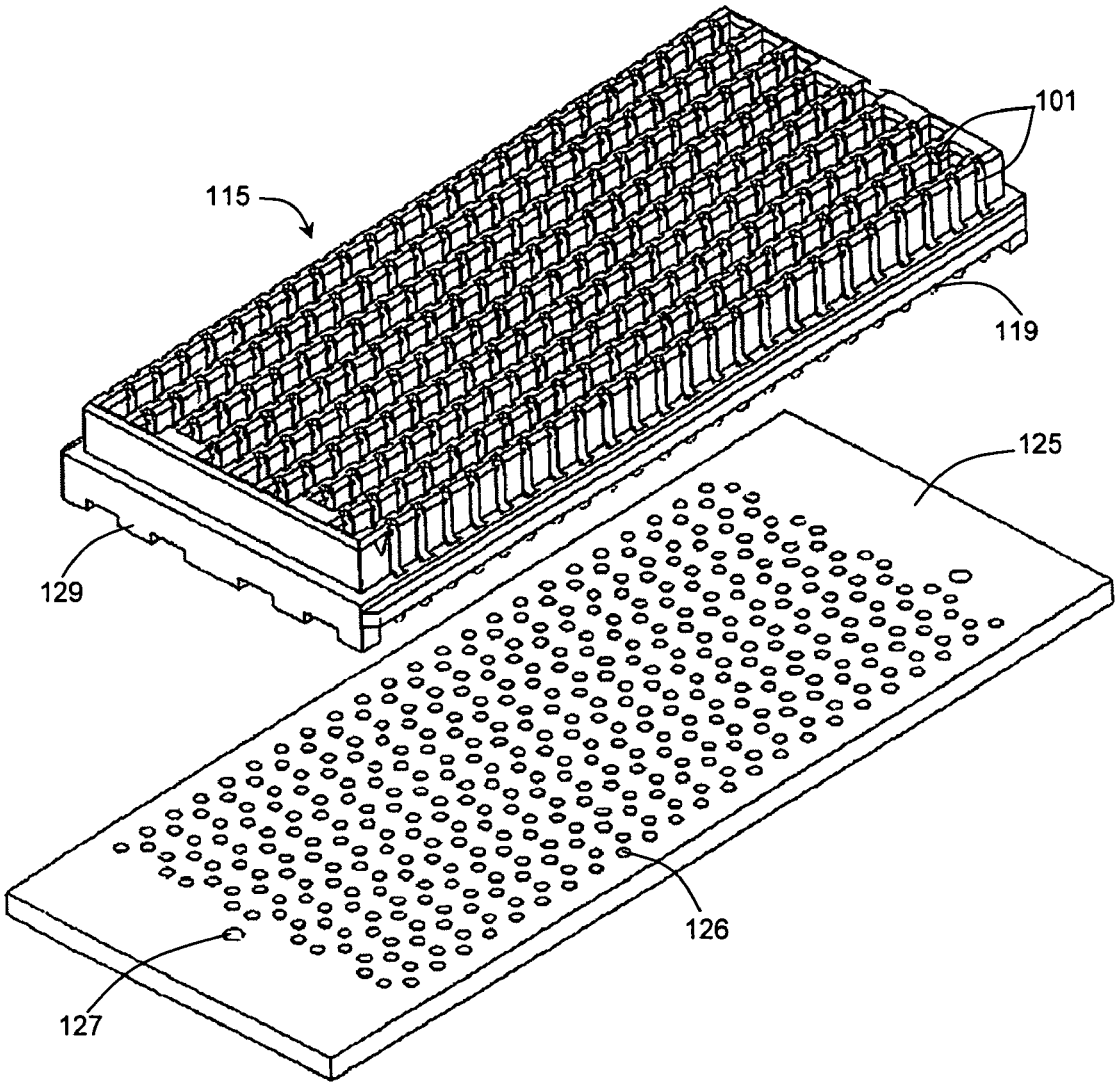
FIG. 9 is an exploded view of the connector and circuit board according to a preferred embodiment of the present invention.
Figure 10:
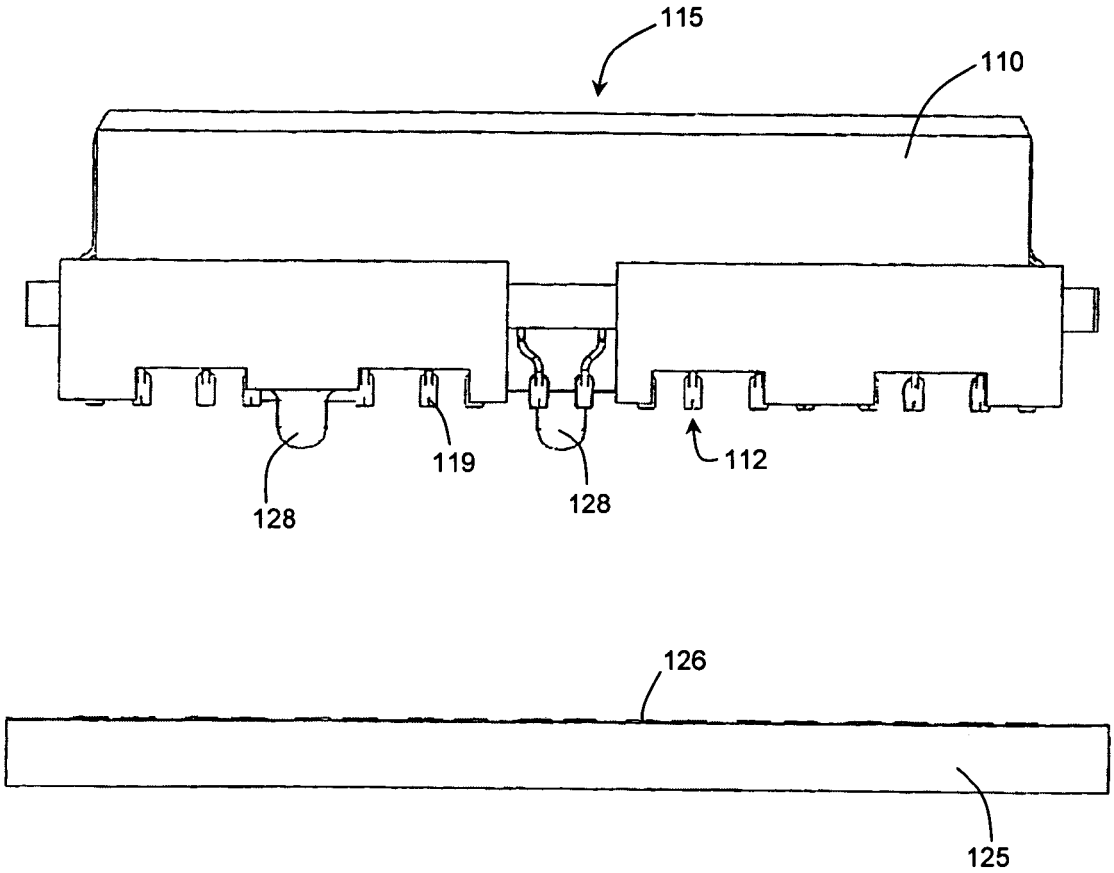
FIG. 10 is a side plan view of the connector and circuit board according to a preferred embodiment of the present invention.

FIGS. 9 and 10 show how the circuit board 125 and header connector 115 are connected. It is easily understood from FIGS. 9 and 10 that socket connector 120 can also be connected as the electrical connector to the circuit board 125 in a similar manner. The alignment pins 128 of the header connector 115 and the alignment holes 127, of the circuit board 125 are arranged such that, when the alignment pins 128 of the header connector 115 engage the alignment holes 127 of the circuit board 125, the bottom 112 of each of the pins 101 of the header connector 115 contacts a corresponding pad 126 of the circuit board 125.

Instead of the alignment holes 127, the bottom of the signal pins of the electrical connector can be aligned with the corresponding pads of the circuit board using automated vision guided placement.

After the electrical connector 100 has been aligned with the circuit board 125, the electrical connector 100 and the circuit board 125 are preferably reflow processed. During the reflow process, the crimped solder member 119 on the bottom 112 of each of the pins 101 is reflowed onto the corresponding pad 126 to form a mechanical and electrical connection between the electrical connector 100 and the circuit board 125. Also during the reflow process, a minimum distance between the connector body 110 and the circuit board 125 is maintained by standoffs 129.

Because of the staggered arrangement of the pins 101, crosstalk between the circuit board 125 and the electrical connector 100 is reduced. Also, standoffs 129 reduce solder joint fatigue by maintaining a minimum distance between the connector body 110 and the circuit board 125.

It is preferable that the reflow process is an Infrared Reflow (IR) process. The reflow process can also be carried out in a convection oven or other suitable means.

Figure 13:
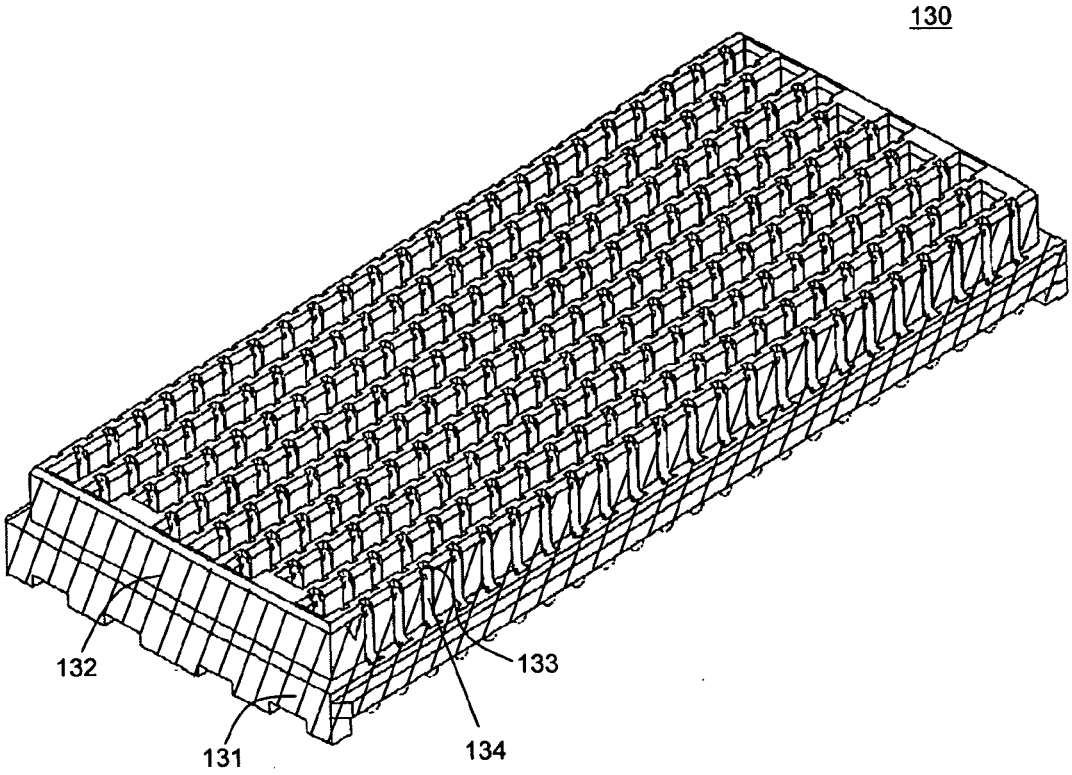
FIG. 13 is a top isometric view of a connector according to another preferred embodiment of the present invention.

As seen in FIG. 13, it is also possible to provide the electrical connector 130 with additional shielding, shown by the cross-hatched portions in this figure. This can be accomplished by forming a metal shield 131 by plating the exterior of the connector body with a metal. The preferable method of plating is plating on plastic (POP).

The metal of the metal shield 131 is preferably plated on the exterior of the connector body 132 and in at least one of the cores 133 that a ground pin 134 will be inserted in. By coating one of the cores 133 that a ground pin 134 will be inserted in, it is not necessary to provide any additional grounding means for the metal shield.

FIG. 13 shows an electrical connector 130 that is used as a header. However, the metal shield 131 can also be applied to an electrical connector that is used as a socket, as shown in FIG. 6.

Further, it is also possible to apply singled ended signals to the signal pins of the differential pins. This can be accomplished by applying one single ended signal through one of the signal pins of each of the differential pairs and applying a second single ended signal through the other of the signal pins. It is also possible to apply one single ended signal through one of the signal pins of each of the differential pair and to apply ground to the other of the signal pins.

Figure 14A:
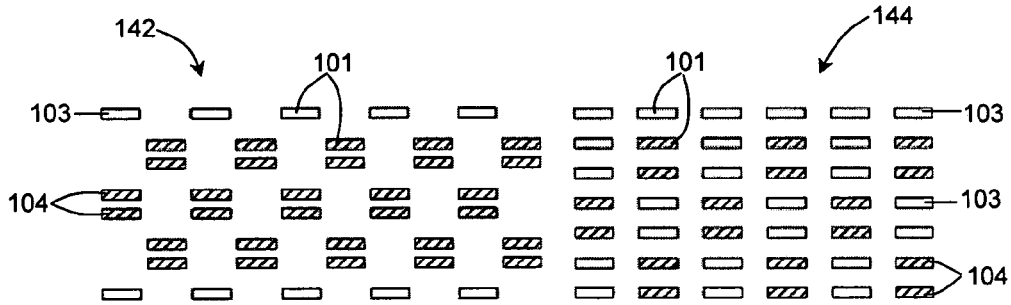
FIG. 14*a* is a schematic view of a pin field of an array connector according to another preferred embodiment of the present invention.
Figure 14B:
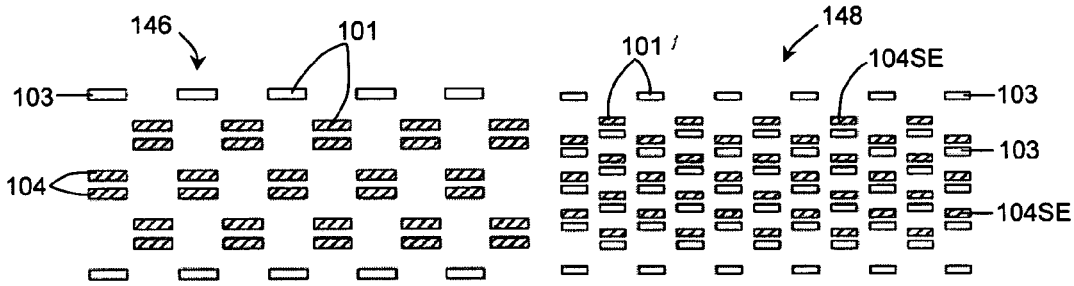
FIG. 14*b* is a schematic view of a pin field of an array connector according to yet a further preferred embodiment of the present invention.

FIGS. 14*a* and 14*b* show additional preferred embodiments of the present invention.

FIG. 14*a* is a schematic view of a pin field of an array connector according to another preferred embodiment of the present invention. As seen in FIG. 14*a*, a first portion 142 of the pin field of the connector is preferably configured similar to the pin field shown in FIG. 2. That is, the pins 101 in the connector of FIG. 14*a* are arranged to have the staggered and stretched arrangement achieved by stretching the pitch of the pins 101 in the row direction R of the pin field and in the column direction of the pin field, and staggering the arrangement of the signal pins that define differential signal pairs 104 to produce a zig-zag arrangement of differential signal pairs 104 seen in FIG. 2.

A second portion 144 of the pin field of the connector shown in FIG. 14*a* is arranged to have a configuration that is similar to the uniformly-spaced, non-staggered arrangement of the pins 1 shown in FIG. 1. Thus, the second portion 144 preferably has an open pin field arrangement, which is defined as a field of pins that are equally spaced in the row and column directions. This configuration is preferred in some applications to increase pin densities.

FIG. 14*b* is a schematic view of a pin field of an array connector according to yet a further preferred embodiment of the present invention. As seen in FIG. 14*b*, the array connector has two different portions of the pin field having two different unique staggered and stretched arrangements of pins 101.

More specifically, a first portion 146 of the pin field of the connector shown in FIG. 14*b* is preferably configured similar to the pin field shown in FIG. 2. That is, the pins 101 of the connector of FIG. 14*b* are preferably arranged to have the staggered and stretched arrangement achieved by stretching the pitch of the pins 101 in the row direction R of the pin field and in the column direction of the pin field, and staggering the arrangement of the signal pins that define differential signal pairs 104 to produce a zig-zag arrangement of differential signal pairs 104 seen in FIG. 2. This arrangement is most suitable for differential pair signal pins.

A second portion 148 of the pin field of the connector shown in FIG. 14*b* is preferably arranged to have a unique configuration that includes pins 101 that are arranged to have a different staggered and stretched arrangement from the staggered and stretched arrangement of signal pins 101 in the first portion 146. As can be seen by a comparison of the arrangement of pins 101 in the first portion 146 of the pin field and the second portion 148 of the pin field, the staggering and stretching of the pins in the second portion 148 is less than that of the first portion 146 such that distances between adjacent pins in the first portion 146 is greater than that of the second portion 148. This second unique staggered and stretched pin arrangement in the second portion 148 is most suitable for single ended signal pins 104SE. Single ended configurations typically require different spacing than differential pair configurations in order to optimize the electrical performance of each portion. Typically, a connector is configured to be optimized for either single ended performance or differential pair performance, or an acceptable medium between these two is chosen. In doing this, one or the other or both of single ended performance or differential pair performance are degraded. By adjusting the staggering and spacing individually in each portion as shown in FIG. 14*b*, optimal performance for each of the single ended portion and the differential pair portion can be achieved.

In one example of the preferred embodiment shown in FIG. 14*b*, the pitch P between each of the pins 101 in the first portion 146 is preferably the same as that described with respect to FIG. 2, and the pitch P' between each of the pins 101 in the second portion 148 is preferably equal to 0.5(P) used in the first portion 146 and in the configuration of FIG. 2. However, the preferred embodiment shown in FIG. 14*b* is not limited to this relationship and pitch arrangement to produce the two different, unique staggered and stretched arrangements of the first portion 146 and the second portion 148 of the connector shown in FIG. 14*b*. The pitches P and P' and these two different, unique staggered and stretched arrangements of the first portion 146 and the second portion 148 of the connector shown in FIG. 14*b* can be modified as desired as long as the effects and advantages of the present invention are achieved.

It should be understood that the foregoing description is only illustrative of the present invention. Various alternatives and modifications can be devised by those skilled in the art without departing from the present invention. Accordingly, the present invention is intended to embrace all such alternatives, modifications and variances which fall within the scope of the appended claims.

What is claimed is:

1. An electrical connector comprising:

a connector body; and a pin field including a plurality of rows of pin pairs, each of the pin pairs include a broad side and a narrow side, and the pin pairs are arranged such that the broad side of a first pin of each respective one of the pin pairs faces the broad side of a second pin of each respective one of the pin pairs along at least a majority of the length of the pin pairs; wherein in at least a first portion of the pin field, adjacent rows of the pin pairs are staggered in a first direction of the connector body such that any of the pin pairs of one row do not align in a second direction of the connector body with any of the pin pairs of an adjacent row of pin pairs.

2. The electrical connector according to claim 1, wherein in a second portion of the pin field, adjacent rows of the pin pairs are uniformly spaced from each other in the first direction of the connector body such that the pin pairs of one row are aligned in the second direction with the pin pairs of an adjacent row.

3. The electrical connector according to claim 1, wherein the first portion of the pin field includes differential pairs of pins.

4. The electrical connector according to claim 1, wherein the electrical connector is a differential pair array connector.

5. The electrical connector according to claim 1, wherein the electrical connector is a single ended array connector.

6. The electrical connector according to claim 1, wherein the electrical connector is a combined differential pair array and single ended array connector.

7. The electrical connector according to claim 1, wherein the staggered arrangement of the pin pairs defines a zig-zag arrangement of the pin pairs in the second direction.

8. The electrical connector according to claim 1, wherein no ground pins are provided in the rows of pin pairs.

9. The electrical connector according to claim 1, wherein the pin pairs in each of the rows are spaced from an adjacent pin pair in the same row by a distance that is approximately equal to a length of the broad side of one of the pins of the pin pairs.

10. The electrical connector according to claim 1, wherein the two pins of each of the pin pairs are spaced from each other by a distance that is approximately equal to one-half of a length of the broad side of one of the pins of the pin pairs.

11. The electrical connector according to claim 1, wherein differential pairs of pins are arranged in columns and rows of the pin field, the differential pairs of pins are arranged in a stretched pattern along the direction of the rows of the pin field.

12. The electrical connector according to claim 1, wherein the connector body includes a plurality of cores which are arranged in a staggered pattern.

13. The electrical connector according to claim 1, wherein the connector body includes a plurality of cores which are arranged in a stretched pattern.

14. The electrical connector according to claim 1, wherein the connector body includes a plurality of cores which are arranged in a staggered and stretched pattern.

15. The electrical connector according to claim 1, wherein the connector body includes at least one standoff for maintaining a minimum distance between the connector body and a circuit board.

16. The electrical connector according to claim 1, wherein in a second portion of the pin field, adjacent rows of the pin pairs are staggered in the first direction of the connector body such that any of the pin pairs of one row do not align in the second direction with any of the pin pairs of an adjacent row of pin pairs, and the amount of staggering of adjacent rows of pin pairs in the first portion of the pin field is different from that of the adjacent rows of pin pairs of the second portion of the pin field.

17. The electrical connector according to claim 16, wherein the first portion of the pin field includes differential pairs of pins and the second portion of the pin field includes single ended pins.

18. The electrical connector according to claim 1, wherein a plurality of ground pins are disposed along at least one side of a periphery of the pin field.

19. The electrical connector according to claim 18, wherein the pins of the pin field and the ground pins have the same configuration.

20. The electrical connector according to claim 18, wherein the pins of the pin field and the ground pins have different configurations.

21. The electrical connector according to claim 1, wherein some pins of the pin field are ground pins.

22. The electrical connector according to claim 21, wherein the pins of the pin field have the same configuration.

23. The electrical connector according to claim 21, wherein the pins of the pin field have different configurations.

24. The electrical connector according to claim 1, wherein a ground shield extends along the perimeter of the connector body.

25. The electrical connector according to claim 24, wherein the ground shield is connected to at least one of the plurality of pins.

26. The electrical connector according to claim 24, wherein the connector body is composed of a plastic and the ground shield is plated on the plastic of the connector body.

* * * * *